US005213018A

United States Patent [19]

Lalone

[11] Patent Number: 5,213,018

[45] Date of Patent: May 25, 1993

[54] PNEUMATIC BRAKE SPRING COMPRESSION APPARATUS

[76] Inventor: Duane R. Lalone, 9651 N. Alger Rd., Alma, Mich. 48801

[21] Appl. No.: 837,945

[22] Filed: Feb. 20, 1992

[51] Int. Cl.[5] ..... B25B 29/00

[52] U.S. Cl. ..... 81/488; 29/227; 29/252

[58] Field of Search ..... 81/488, 486; 29/227, 29/252; 7/100

[56] References Cited

U.S. PATENT DOCUMENTS

| | | | |
|---|---|---|---|
| 2,883,741 | 4/1959 | Yerkes | 29/252 |
| 3,504,419 | 4/1970 | Bozsanyi | 29/227 |
| 4,338,711 | 7/1982 | Wright | 29/227 |

*Primary Examiner*—Roscoe V. Parker
*Attorney, Agent, or Firm*—Leon Gilden

[57] ABSTRACT

A tool structure is arranged to include a pneumatic chamber with a piston and rod mounted and directed through the chamber coaxially thereof, with a forward end of the rod terminating in a rectilinear plate received through a slot within a pneumatic reservoir of a pneumatic brake organization. The rectilinear plate is arranged for engaging a forward end of a spring member within the pneumatic brake reservoir and its compression therewithin upon application of pneumatic pressure within the tool chamber. A modification of the invention includes an alignment block received within the brake chamber to effect a latching of the engaging plate in a retracted orientation preventing its rotation.

3 Claims, 4 Drawing Sheets

PNEUMATIC BRAKE SPRING COMPRESSION APPARATUS

BACKGROUND OF THE INVENTION

1. Field of the Invention

The field of invention relates to brake tool apparatus, and more particularly pertains to a new and improved pneumatic brake spring compression apparatus wherein the same is arranged to effect the retraction of a spring within a pneumatic brake chamber reservoir.

2. Description of the Prior Art

Various pneumatic brake systems are utilized throughout the prior art to effect the braking of large vehicles such as the organization as illustrated and set forth in the U.S. Pat. No. 4,943,079 to Harbold.

U.S. Pat. No. 4,685,164 to Sebalos sets forth an air brake adjustment tool arranged for the adjustment of use of automotive vehicles.

Accordingly, it may be appreciated that there continues to be a need for a new and improved pneumatic brake spring compression apparatus as set forth by the instant invention which addresses both the problems of ease of use as well as effectiveness in construction in providing for the compression of a spring within a pneumatic brake chamber to effect repair upon the chamber and in this respect, the present invention substantially fulfills this need.

SUMMARY OF THE INVENTION

In view of the foregoing disadvantages inherent in the known types of brake tool apparatus now present in the prior art, the present invention provides a pneumatic brake spring compression apparatus wherein the same utilizes a reciprocating plate arranged to compress a spring within a pneumatic brake reservoir. As such, the general purpose of the present invention, which will be described subsequently in greater detail, is to provide a new and improved pneumatic brake spring compression apparatus which has all the advantages of the prior art brake tool apparatus and none of the disadvantages.

To attain this, the present invention provides a tool structure arranged to include a pneumatic chamber with a piston and rod mounted and directed through the chamber coaxially thereof, with a forward end of the rod terminating in a rectilinear plate received through a slot within a pneumatic reservoir of a pneumatic brake organization. The rectilinear plate is arranged for engaging a forward end of a spring member within the pneumatic brake reservoir and its compression therewithin upon application of pneumatic pressure within the tool chamber. A modification of the invention includes an alignment block received within the brake chamber to effect a latching of the engaging plate in a retracted orientation preventing its rotation.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pneumatic brake spring compression apparatus which has all the advantages of the prior art brake tool apparatus and none of the disadvantages.

It is another object of the present invention to provide a new and improved pneumatic brake spring compression apparatus which may be easily and efficiently manufactured and marketed.

It is a further object of the present invention to provide a new and improved pneumatic brake spring compression apparatus which is of a durable and reliable construction.

An even further object of the present invention is to provide a new and improved pneumatic brake spring compression apparatus which is susceptible of a low cost of manufacture with regard to both materials and labor, and which accordingly is then susceptible of low prices of sale to the consuming public, thereby making such pneumatic brake spring compression apparatus economically available to the buying public.

Still yet another object of the present invention is to provide a new and improved pneumatic brake spring compression apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
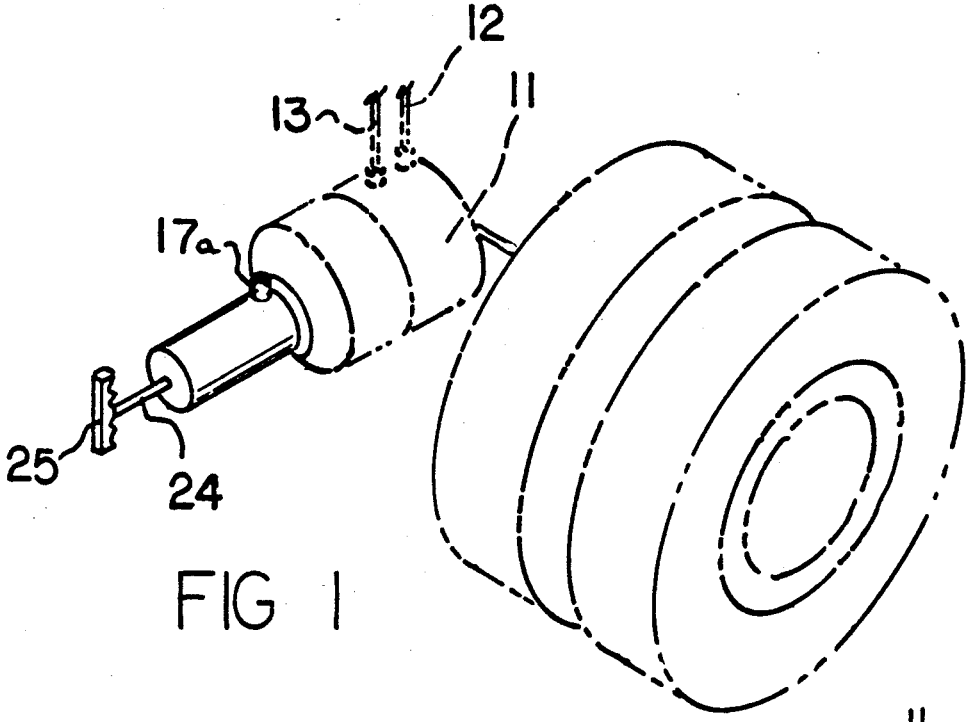
FIG. 1 is an isometric illustration of the invention in use.
Figure 2:
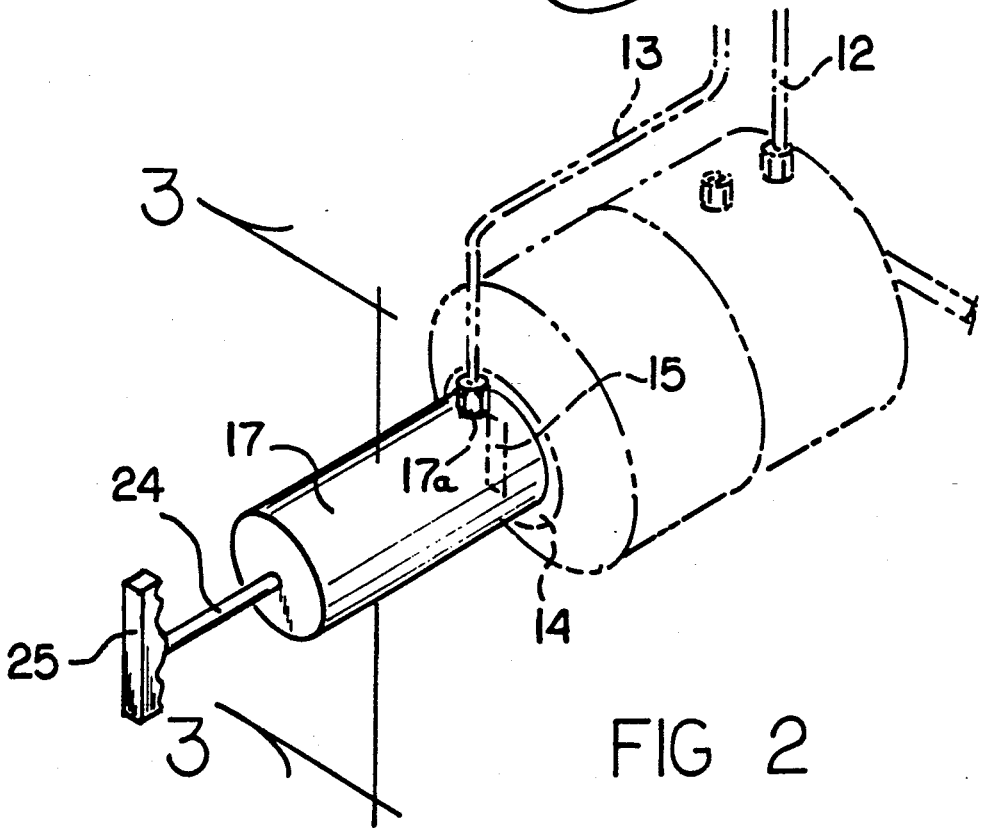
FIG. 2 is an enlarged isometric illustration of the invention illustrating the directing of a pneumatic conduit to the tool structure.
Figure 3:
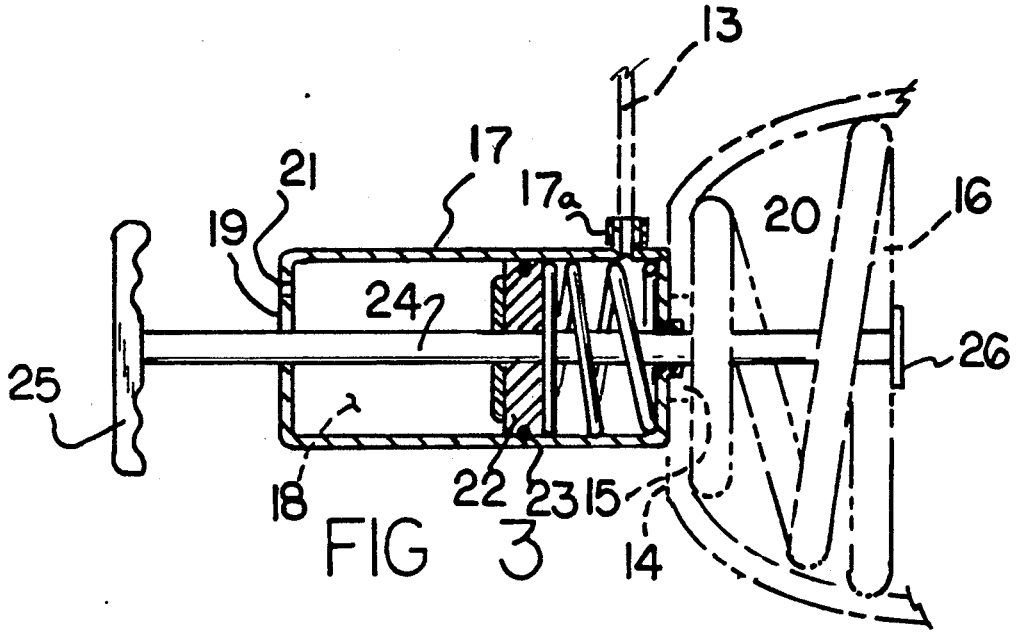
FIG. 3 is an orthographic view, taken along the lines 3—3 of FIG. 2 in the direction indicated by the arrows.
Figure 4:
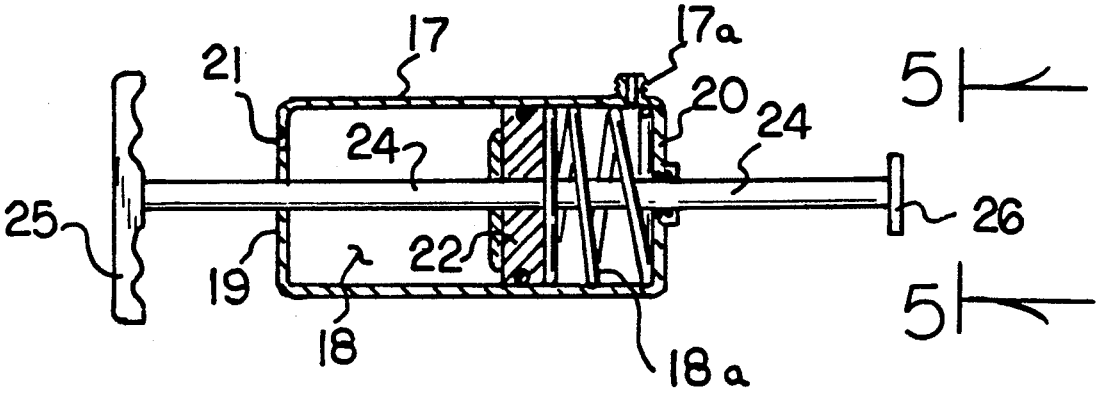
FIG. 4 is an orthographic cross-sectional illustration of the invention in a separated orientation relative to the pneumatic reservoir chamber.
Figure 5:
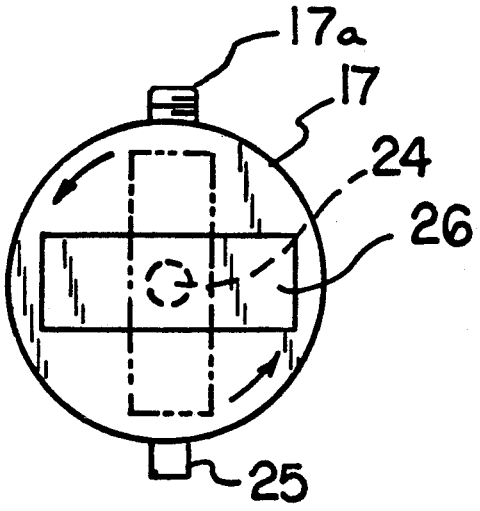
FIG. 5 is an orthographic view, taken along the lines 5—5 of FIG. 4 in the direction indicated by the arrows.

With reference now to the drawings, and in particular to FIGS. 1 to 7 thereof, a new and improved pneumatic brake spring compression apparatus embodying the principles and concepts of the present invention and generally designated by the reference numerals 10 and 10*a* will be described.

More specifically, the pneumatic brake spring compression apparatus 10 of the instant invention essentially comprises the use of a tool to effect compression of a chamber spring 16 (see FIG. 3), wherein the spring is positioned within a pneumatic brake reservoir chamber 11 that includes a respective first and second pneumatic chamber conduit 12 and 13 directed thereto for actuation of the reservoir chamber, in a manner available in the prior art. The chamber 11 includes a chamber end wall 14, with a slot 15 directed therethrough into the chamber 11. The chamber spring 16 is positioned adjacent the end wall 14 and the slot 15 that is coaxially directed relative to the spring 16. A tool cylinder 17 that includes a tool cylinder forward end wall 20 spaced from and parallel a tool cylinder rear end wall 19 defining a pneumatic chamber 18 therewithin is positioned in abutment with the chamber end wall 14 by the forward end wall 20. A vent opening 21 is directed through the rear end wall 19. A piston 22 including a circumferential piston seal 23 is slidably mounted within the chamber 18, with a chamber spring 18*a* captured between the piston 22 and the chamber forward end wall 20. A piston rod 24 fixedly mounted coaxially of the piston 22 extends slidably and sealingly through the forward and rear end wall 19 and 20. A handle 25 is fixedly and orthogonally mounted relative to a rear distal end of the rod 24, with a rectilinear plate 26 fixedly and orthogonally mounted to a forward distal end of the piston rod 24 as the piston rod 24 medially intersects the plate 26. In this manner, the plate 26 is directed through the chamber end wall slot 15 and upon rotation of the plate, the plate engages the spring, whereupon application of pneumatic pressure from the first or second chamber conduit 13 directed into the pneumatic chamber through the pneumatic coupling 17*a* effects retraction of the piston towards the chamber rear end wall 19, and accordingly the compression of the spring that is secured or engaged by the plate 26.

Figure 6:
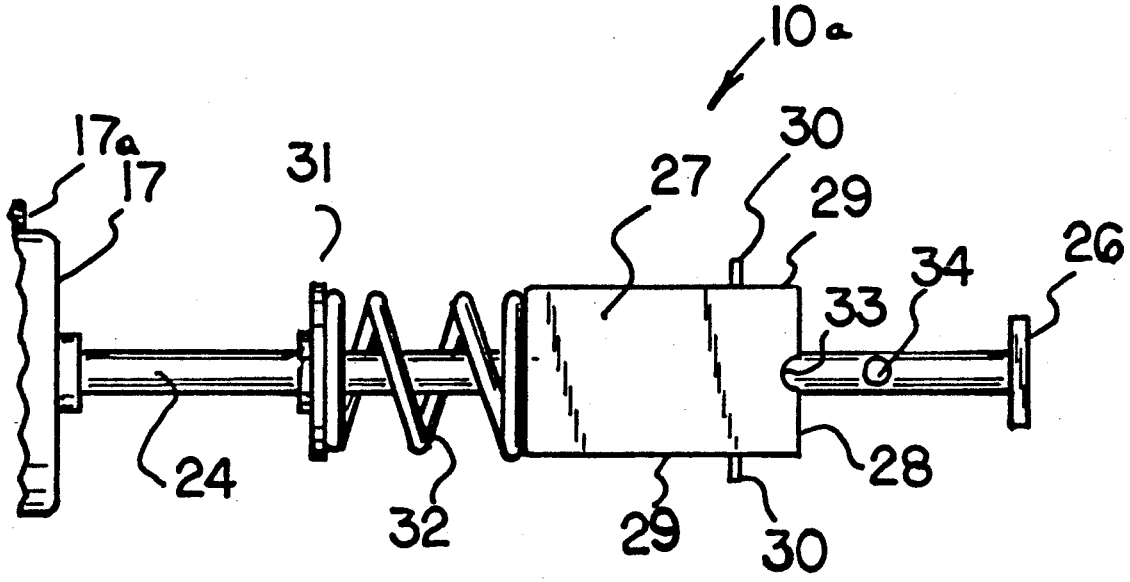
FIG. 6 is an orthographic side view of a modification of the invention.
Figure 7:
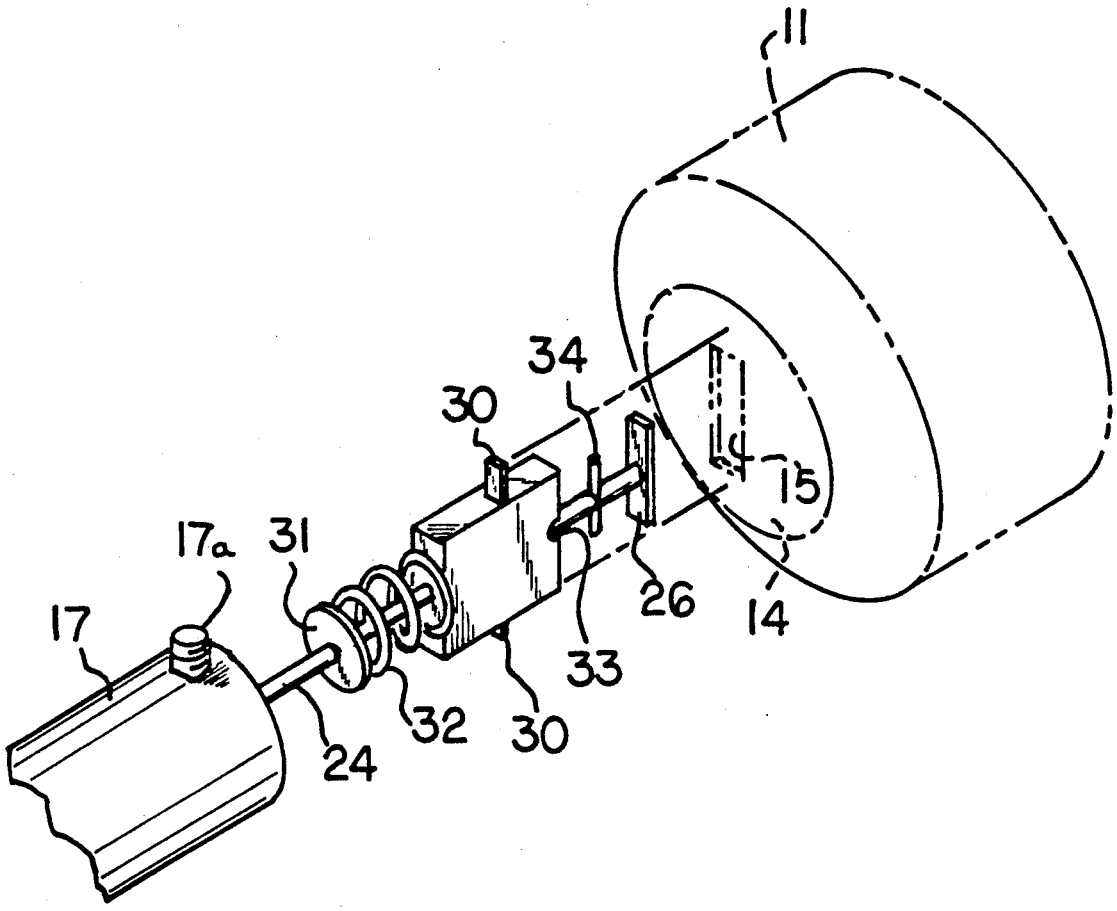
FIG. 7 is an isometric illustration of the modified invention arranged relative to a pneumatic brake reservoir chamber.

A modified apparatus 10*a* is set forth in the FIGS. 6 and 7 to include an alignment block 17 of a parallelepiped configuration, including a block forward end wall 28 that is complementarily received within the slot 15 through the chamber end wall 14. The piston rod 24 is rotatably directed medially and longitudinally of the alignment block 27. The alignment block 27 includes parallel side walls 29, with each side wall including a flange 30 projecting orthogonally relative to the side walls a predetermined spacing from the alignment block forward end wall 28. In this manner, the alignment block 27 is projected into the reservoir chamber 11 the predetermined spacing between the alignment block forward end wall 28 and the flanges 30. A rod abutment plate is arranged in a parallel relationship rearwardly of the alignment block 27 and captures a rod spring 32 between the abutment plate 31 and a rear wall of the alignment block 27 to bias the alignment block forwardly of the piston rod, as illustrated. The block forward end wall 28 includes a groove 33 directed across the forward end wall oriented parallel and medially of the side walls 29. A cylindrical piston rod bar 34 is orthogonally and fixedly directed through the piston rod 24 between the block forward end wall 28 and the piston rod plate 26. In this manner, retraction of the plate by the pneumatic deflection of the piston 22 towards the chamber rear end wall 19 effects reception of the bar 34 within the groove 33 preventing rotation of the plate 26 relative to the chamber spring 16 thereby preventing disengagement of the plate 26 relative to the spring 16 permitting repair to the chamber reservoir 11 that requires retraction of the chamber springs 16.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pneumatic brake spring compression apparatus for use in cooperation with a pneumatic brake reservoir chamber, the reservoir chamber including at least one chamber conduit directed into the reservoir chamber, and including a chamber end wall, the chamber end wall including a slot directed therethrough of rectilinear configuration, and a spring positioned within the reservoir chamber adjacent the chamber end wall, wherein the apparatus comprises, a tool cylinder, the tool cylinder including a cylinder rear end wall and a cylinder forward end wall, wherein the cylinder rear end wall is arranged in a parallel relationship relative to the cylinder forward end wall, and a chamber defined within the cylinder, and a pneumatic coupling directed through the cylinder into the chamber for reception of the at least one chamber conduit in securement thereto, and a vent opening directed through the cylinder rear end wall, and a piston slidably mounted within the cylinder between the cylinder forward end wall and the cylinder rear end wall, and a piston rod coaxially directed through the cylinder, with the piston rod including a rod forward distal end and spaced from the forward end wall, and a rod rear distal end spaced from the rod rear end wall, and a piston spring captured between the piston and the cylinder forward end wall, the piston rod rear distal end including a handle fixedly mounted thereto, the piston rod forward distal end including a rectilinear plate fixedly secured thereto orthogonally intersected medially of the plate by the piston rod.

2. An apparatus as set forth in claim 1 wherein the piston rod includes a parallelepiped alignment block rotatably secured relative to the piston rod between the plate and the cylinder forward end wall, and a rod abutment plate fixedly mounted to the piston rod between the alignment block and the cylinder forward end wall, with a rod spring wound about the piston rod between the rod abutment plate and the alignment block.

3. An apparatus as set forth in claim 2 wherein the alignment block includes a block forward end wall and spaced parallel block side walls, each of the side walls includes a side wall flange fixedly mounted to the side walls spaced from the block forward end wall a predetermined spacing, and the block forward end wall including a forward end wall groove directed across the forward end wall oriented parallel relative to the block side walls, and a cylindrical piston rod bar orthogonally directed through the piston rod between the rod plate and the block forward end wall for reception of the bar within the groove when the piston is retracted within the chamber.

* * * * *